US008783346B2

(12) United States Patent
Taherian et al.

(10) Patent No.: US 8,783,346 B2
(45) Date of Patent: Jul. 22, 2014

(54) SYSTEM AND METHOD FOR IMPROVING OPERATIONAL CHARACTERISTICS

(71) Applicant: Schlumberger Technology Corporation, Sugar Land, TX (US)

(72) Inventors: Reza Taherian, Al-Khobar (SA); Henry N. Bachman, Al-Khobar (SA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/909,590

(22) Filed: Jun. 4, 2013

(65) Prior Publication Data

US 2013/0264050 A1 Oct. 10, 2013

Related U.S. Application Data

(63) Continuation of application No. 12/126,027, filed on May 23, 2008, now Pat. No. 8,453,730.

(51) Int. Cl.
*E21B 47/00* (2012.01)

(52) U.S. Cl.
USPC ..... 166/250.01; 166/244.1; 166/247; 343/719; 343/787; 343/788

(58) Field of Classification Search
USPC ..... 343/719, 787, 788; 166/250.01, 244.1, 166/247
See application file for complete search history.

(56) References Cited

U.S. PATENT DOCUMENTS

| | | | | |
|---|---|---|---|---|
| 2,849,070 | A | 8/1958 | Maly | |
| 3,016,093 | A | 1/1962 | Bodine | |
| 6,447,871 | B1 | 9/2002 | Hawkins | |
| 6,691,779 | B1 * | 2/2004 | Sezginer et al. | 166/250.01 |
| 7,436,184 | B2 * | 10/2008 | Moore | 324/347 |
| 2002/0153136 | A1 * | 10/2002 | Kruspe et al. | 166/250.01 |
| 2006/0151179 | A1 | 7/2006 | Boyadjieff et al. | |
| 2009/0192718 | A1 | 7/2009 | Zhang et al. | |
| 2009/0239049 | A1 | 9/2009 | Hook et al. | |

FOREIGN PATENT DOCUMENTS

| | | | |
|---|---|---|---|
| KR | 20060009826 | A | 2/2006 |
| WO | 91/01210 | A1 | 2/1991 |

OTHER PUBLICATIONS

T. Jaglinski et al., "Composite Materials with Viscoelastic Stiffness Greater than a Diamond," Science, v. 315, pp. 620-622 (Feb. 2, 2007).
International Search Report for PCT Application Serial No. PCT/US2009/040091 dated Nov. 18, 2009.

* cited by examiner

*Primary Examiner* — Tho G Phan
(74) *Attorney, Agent, or Firm* — Kimberly Ballew; Kenneth Liu

(57) ABSTRACT

In one embodiment, an apparatus includes an antenna having a conductive winding, with the antenna disposed about a channel. A characteristic improvement material is disposed between the antenna and the channel. In some embodiments, the characteristic improvement material includes at least one of a negative stiffness material or a negative Poisson's ratio material. Various systems and methods are also disclosed herein.

18 Claims, 6 Drawing Sheets

SYSTEM AND METHOD FOR IMPROVING OPERATIONAL CHARACTERISTICS

CROSS REFERENCE TO RELATED APPLICATION(S)

This application is a continuation of U.S. patent application Ser. No. 12/126,027, titled "System and Method for Improving Operational Characteristics," filed on May 23, 2008, the complete disclosure of which is hereby incorporated by reference herein.

BACKGROUND

In many well related operations, downhole devices are subjected to vibration and other detrimental effects. For example, radio frequency antennas can suffer from vibration in the form of unwanted noise known as ringing or coil disease. Ringing results from the vibration of materials used to make the antenna or surrounding components. The materials may include high mu ferrites, metallic conductors, and other materials coupled to or contacting the antenna. Vibrations can be induced by externally applied mechanical vibrations or from electromagnetic interactions causing transient impulses that convert to mechanical vibrations. Any or all of the components of an antenna or adjacent structure can vibrate, and the vibrations induce unwanted signals in the antenna. If the antenna or other susceptible downhole component is proximate a magnetic field, as occurs in a magnetic resonance application, the Lorentz force on moving charges in the magnetic field can provide an additional mechanism for producing vibration.

Antennas are used in many downhole logging applications, and the antennas are located in logging tools to make electromagnetic measurements. The logging tools and associated antennas must operate under extreme pressure, temperature and mechanical shock conditions. However, the antennas must be sensitive enough to measure extremely low voltages while remaining mechanically robust to endure the extreme conditions. This can be particularly true for magnetic resonance applications in wellbore environments. However, existing materials used in constructing or used in cooperation with antennas and other sensitive downhole equipment are susceptible to these vibrations.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In general, the present disclosure provides a system and method for improving the operational characteristics of a well device while the device is used in a wellbore environment. The well device benefits from a unique material, in the form of negative stiffness material or negative Poisson's ratio material, positioned to improve the operational characteristics of the well device. For example, the material can be located to reduce vibration that would otherwise interfere with operation of the well device.

In accordance with one embodiment, an apparatus includes an antenna having a conductive winding, with the antenna disposed about a channel. A characteristic improvement material is disposed between the antenna and the channel.

In accordance with another embodiment, a logging tool includes an antenna having a first x-coil winding and a first y-coil winding. The logging tool further includes a circuit board having a characteristic improvement material, wherein the first x-coil and y-coil windings of the antenna are mounted on the circuit board, and wherein the presence of the characteristic improvement material in the circuit board dampens vibrations for the antenna.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of embodiments of the present disclosure without limitation to the claimed subject matter.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
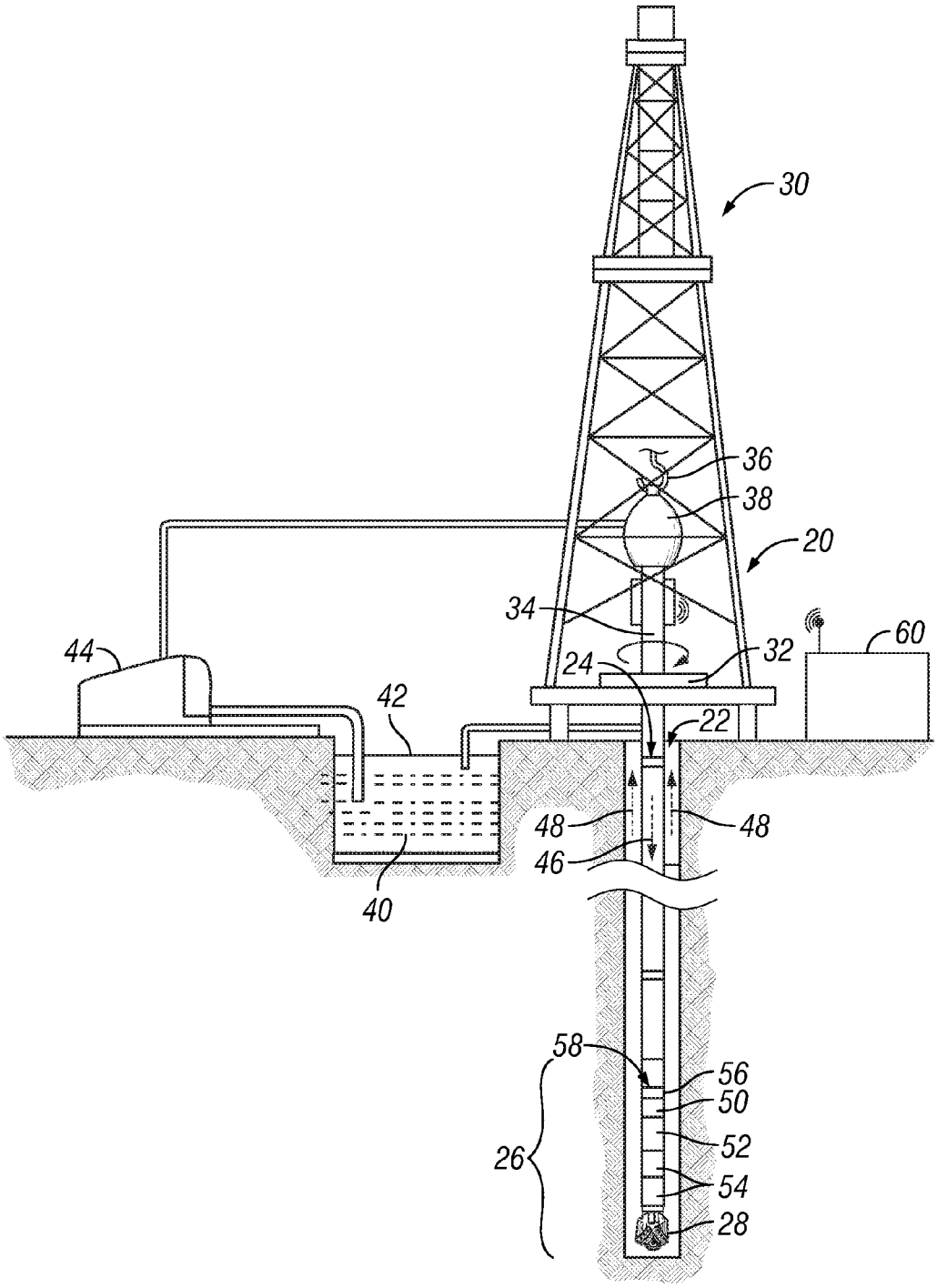
FIG. 1 is a front elevation view of a well system deployed in a wellbore, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present disclosure generally relates to a well system utilizing a "characteristic improvement" material to improve the function of a downhole device. The characteristic improvement material may include a negative stiffness material or a negative Poisson's ratio material that can be incorporated into a composite material. The composite material is then positioned to improve the functionality of the well device. For example, the composite can be positioned to reduce vibration detrimental to the function of a specific well device, such as an antenna module. The unique characteristic improvement materials are well-suited to reduce or eliminate mechanical vibrations and thus parasitic ringing in the antenna or other well devices susceptible to these effects. In many applications, the characteristic improvement material can be incorporated into a positive stiffness bulk material to create a stable composite material having greater stiffness and higher damping qualities compared to the positive stiffness material alone.

Stiffness is a measure of the response of a material to an applied force. For a "normal" or positive stiffness material, the material deflects in the same direction as the direction of an applied force. Negative stiffness materials, however, are materials in which the deflection is in the opposite direction to that of the applied force. As a result, negative stiffness materials behave as though they are very stiff. Negative stiffness materials have been studied extensively by Professor Lakes and his associates at the University of Wisconsin-Madison. A review of negative stiffness material qualities can be found in an article discussing their work in Jaglinski, et al., Science 315, 620 (2007).

Negative Poisson's ratio materials are similar to negative stiffness materials and are also known by the terms auxetic or dilational. Poisson's ratio is defined as the negative of the transverse strain divided by the longitudinal strain. Accordingly, a pulling force in one direction on a negative Poisson's ratio material results in an increase in size in the transverse dimension, contrary to positive Poisson's ratio materials. Deformations of negative Poisson's ratio materials do not conserve volume. Examples of negative Poisson's ratio materials can be found in nature and are stable.

Dilute quantities of negative stiffness material can be incorporated into a matrix of positive stiffness material. Such a design creates a composite material that is extremely stiff and has high damping properties relative to the positive stiffness material alone and relative to other materials used in downhole applications. Damping can be quantified by the product Etan(d), where E is the stiffness and tan(d) is the loss tangent that measures vibration attenuation of the material. Higher values of Etan(d) indicate better overall performance where stiffness and damping are required. Negative stiffness materials have been shown to have values of Etan(d) that are up to 20 times greater than those for traditional positive stiffness materials. One example of such a composite comprises the ferroelastic material vanadium dioxide ($VO_2$) added as inclusions in a matrix of tin (Sn). Negative Poisson's ratio materials similarly can be mixed with bulk material to create a composite material having great stiffness and high damping properties relative to the bulk material alone and relative to other materials used in downhole applications.

The characteristic improvement material can be used in a variety of downhole devices to reduce unwanted vibration or other deleterious effects. For example, the characteristic improvement materials can be prepared as composite material that is used in the structure of antennas to reduce unwanted ringing. The materials may be embedded in the antenna supporting structure or used as additional layers in forming the antenna. In one embodiment, the antenna module comprises a coil, or any conductive loop of a given geometry, combined with the composite containing a negative stiffness material or a negative Poisson's ratio material. The antenna typically is mounted on a tool, such as a logging tool, and used for transmitting and/or receiving electromagnetic energy.

The characteristic improvement material can be used as a damping material placed between an antenna and an adjacent structure in a given well device. In this application, the composite may be selected to have insulating qualities. Alternatively, the characteristic improvement material may be formed as part of the antenna structure itself or as a magnet or high mu material. Use of the material may vary from one application to another depending on the well environment and the particular function of a given well device.

In induction logging, magnetic resonance logging, and other logging techniques, an antenna is an important component in the logging device. The antenna must be sensitive enough to detect subtle changes in a signal, such as an induced voltage signal from nuclear spins in the reservoir, while also withstanding extremes of temperature, pressure and mechanical shock. With sensitive detection circuits, such as antenna circuits, spurious induced voltages, generally known as ringing, can have a deleterious effect on the quality and usefulness of collected data.

Ringing can result from multiple sources. For example, vibrations can induce ringing and those vibrations can result from shocks during logging or from Lorentz forces on the antenna coil during and after an electromagnetic pulse. Ringing also can be caused by magnetostriction where electromagnetic radiation results in rapid changes of length in a material that is coupled to the antenna. These effects can be substantially mitigated through the use and proper placement of negative stiffness materials and/or negative Poisson's ratio materials.

Referring generally to FIG. 1, one embodiment of a well system 20 that benefits from the characteristic improvement material is illustrated, however a wide variety of other well systems and applications can be used. In the embodiment illustrated, a wellbore 22 is formed in subsurface formations by an appropriate drilling procedure. A tool string 24, such as a drill string, is suspended within wellbore 22 and comprises a bottom hole assembly 26 having, for example, a drill bit 28 positioned at its lower end. In this embodiment, well system 20 also comprises a surface platform and derrick assembly 30 positioned over the wellbore 22. By way of example, the assembly 30 may comprise a rotary table 32, a kelly 34, a hook 36 and a rotary swivel 38.

The drill string 24 is rotated by rotary table 32 which engages the kelly 34 at the upper end of the drill string. The drill string 24 is suspended from hook 36 through the kelly 34 and the rotary swivel 38. The rotary swivel 38 permits rotation of drill string 24 relative to hook 36. However, a top drive system or other systems also can be used in cooperation with drill string 24 or a variety of other tool strings.

In the example illustrated, well system 20 further comprises drilling fluid/mud 40 stored in a pit 42 formed at the well site. A pump 44 is operated to deliver the drilling fluid 40 through the interior of drill string 24 via an appropriate port in rotary swivel 38. The drilling fluid 40 then flows downwardly through the interior of drill string 24 as indicated by arrow 46 until exiting the drill string 24 via appropriate ports in drill bit 28. After exiting the drill bit, the drilling fluid circulates upwardly through an annulus surrounding the drill string, as indicated by arrows 48. The flow of drilling fluid lubricates drill bit 28 and carries formation cuttings up to the surface.

Drill string 24, and other tool strings used for a variety of downhole operations, often have one or more components amenable to improved functionality through the incorporation of negative stiffness materials and/or negative Poisson's ratio materials. In the illustrated embodiment, for example, bottom hole assembly 26 comprises a plurality of components including a logging device 50, that may be a logging-while-drilling module, and a measuring-while-drilling module 52. Alternate or additional measurement modules 54 also can be incorporated into bottom hole assembly 26. Any or all of these devices may utilize components susceptible to vibration. For example, each of these devices may comprise an antenna module 56 having an antenna 58 with enhanced functionality due to the incorporation of characteristic improvement material, as described below. The characteristic improvement material can be used to form components of antenna module 56 and/or for insertion between the antenna 58 and a surrounding structure.

As illustrated, the antenna module 56 may form part of logging device 50 and facilitate the logging device capabilities for measuring, processing and storing information. Additionally, the logging device may be used to communicate information to, for example, a logging and control system 60 located at the surface. In many applications, the logging device 50 also comprises a nuclear magnetic resonance measuring device.

Figure 2:
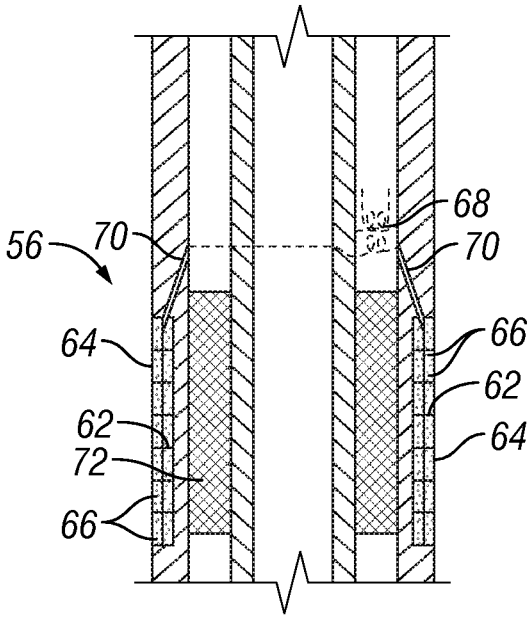
FIG. 2 is a cross-sectional view of an antenna module used with the well system of FIG. 1, according to an embodiment of the present invention.
Figure 3:
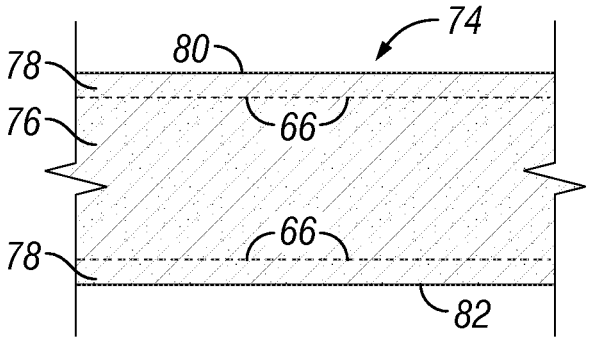
FIG. 3 is a schematic illustration of a composite material incorporating a characteristic improvement material, according to an embodiment of the present invention.

Referring generally to FIG. 2, one example of an antenna module 56 is illustrated. In this embodiment, antenna module 56 may be part of a pulsed nuclear magnetic resonance logging device having one or more antenna 62. Each antenna 62 may comprise an RF antenna protected by a cover 64, such as a non-magnetic cover. In this embodiment, cover 64 comprises a characteristic improvement material 66, in the form of a negative stiffness material or a negative Poisson's ratio material, to minimize the exposure of each antenna to induced vibration. The use of material 66 substantially improves the ability of each antenna 62 to produce and receive pulsed RF electromagnetic energy.

Although a variety of antenna module configurations can be utilized, the illustrated embodiment grounds the antennas 62 to a drill collar at one end, while coupling the antennas to an RF transformer 68 at the other end via pressure feed-throughs 70. A magnet 72, such as a cylindrical magnet, produces a static magnetic field in the well formations. The antenna can be arranged to produce an oscillating RF magnetic field. The oscillating magnetic field excites nuclei of substances in the formations and may be axially symmetric to facilitate measurements during rotation of drill string 24. It should be noted, however, that material 66 may be arranged in a variety of locations and configurations to provide substantially increased support and stiffness for the antenna 62 which, in turn, reduces vibration that would otherwise have a detrimental effect on the functionality of the antenna 62.

Whether the negative stiffness material/negative Poisson's ratio material is used to improve the functionality of an antenna or another type of downhole device, the material 66 often is incorporated into a base material to create a composite material 74, as illustrated in FIGS. 3 through 6. In the example illustrated in FIG. 3, composite 74 is formed with a base or bulk material 76 that serves as a structural component for combination with material 66. In the example illustrated, strips 78 of negative stiffness material or negative Poisson's ratio material 66 are arranged along an upper surface 80 and a lower surface 82 of the composite 74. The composite 74 can be used to form structural components or for combination with structural components of antenna module 56 and/or other well devices.

Figure 4:
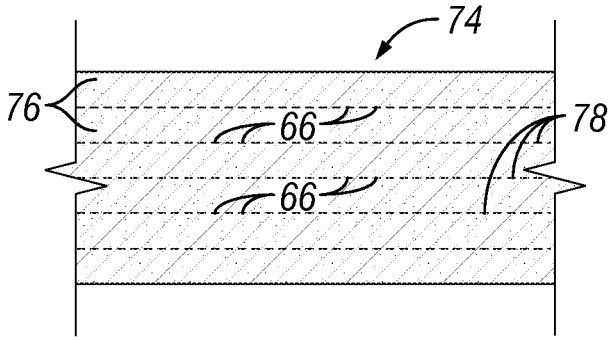
FIG. 4 is another schematic illustration of a composite material incorporating a characteristic improvement material, according to an alternate embodiment of the present invention.
Figure 5A:
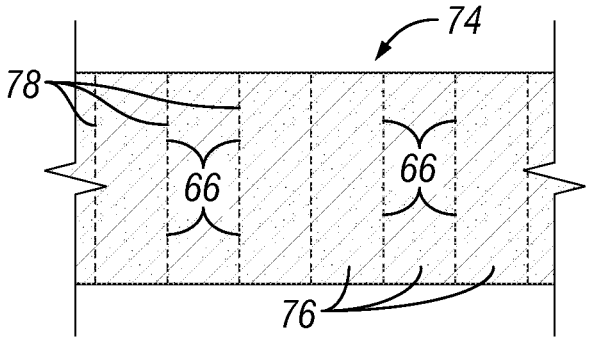
FIGS. 5A and 5B are other schematic illustrations of a composite material incorporating a characteristic improvement material, according to alternate embodiments of the present invention.
Figure 5B:
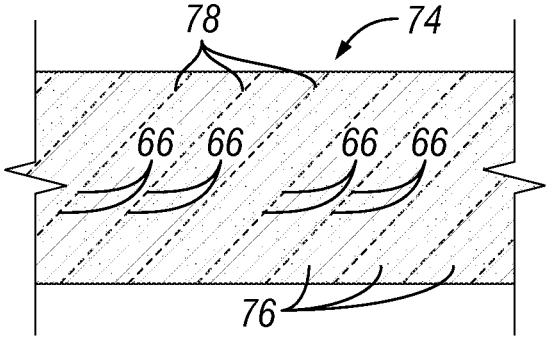
Figure 6:
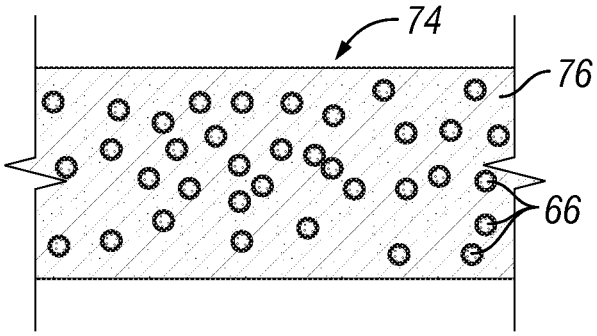
FIG. 6 is another schematic illustration of a composite material incorporating a characteristic improvement material, according to an alternate embodiment of the present invention.

In FIG. 4, another example of composite 74 is illustrated. In this embodiment, strips 78 of material 66 are arranged to create layers within the composite 74. The layers can be formed in a generally longitudinal direction, as illustrated in FIG. 4, or in a generally angled arrangement with respect to the longitudinal axis, including the perpendicular arrangement illustrated in FIG. 5. A combination of layers at different angular orientations can also be used. The material 66 also can be disbursed or distributed throughout the structural material 76, as illustrated in FIG. 6. These and other combinations of material 66 and structural material 76 create composite materials having extremely high stiffness and damping properties that are beneficial in many well devices. Additionally, different patterns or mixtures of material 66 and structural material 76 can be used in combination within a given well device or in cooperation with that well device. Furthermore, the ratio of material 66 to base material 76 can be adjusted from one application to another to obtain the desired improvement in well device functionality through, for example, reduction of vibration.

Figure 7:
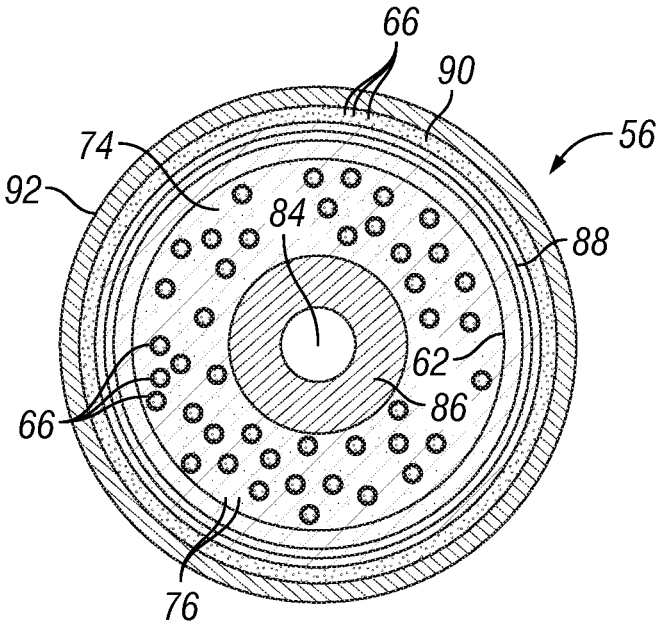
FIG. 7 is a cross-sectional view of one embodiment of an antenna module for use in a wellbore, according to an embodiment of the present invention.

Another embodiment of antenna module 56, illustrated in FIG. 7, incorporates characteristic improvement material 66 through the use of composite 74 placed within the antenna module. As illustrated, the antenna module 56 is designed for use with resistivity tools, NMR tools, or telemetry tools used in a wellbore. In this design, antenna module 56 may comprise a mud channel 84 in a while-drilling tool (or a "thru-wiring" channel in a wireline tool) disposed through a conductive material 86 that may be formed as a conductive cylinder to provide mechanical strength. The conductive material 86 may be formed from a tool string collar material that is machined to provide space for the antenna 62 which may be held adjacent or within the composite 74. The composite material 74, containing negative stiffness material/negative Poisson's ratio material 66, is disposed around conductive material 86 and separates the conductive material 86 from a conductive winding 88. An additional layer 90 of composite material 74 can be layered over the conductive winding 88 to fill the space between conductive winding 88 and a surrounding nonconductive shell 92. The layer 90 provides increased mechanical integrity to the coil winding 88.

Figure 8:
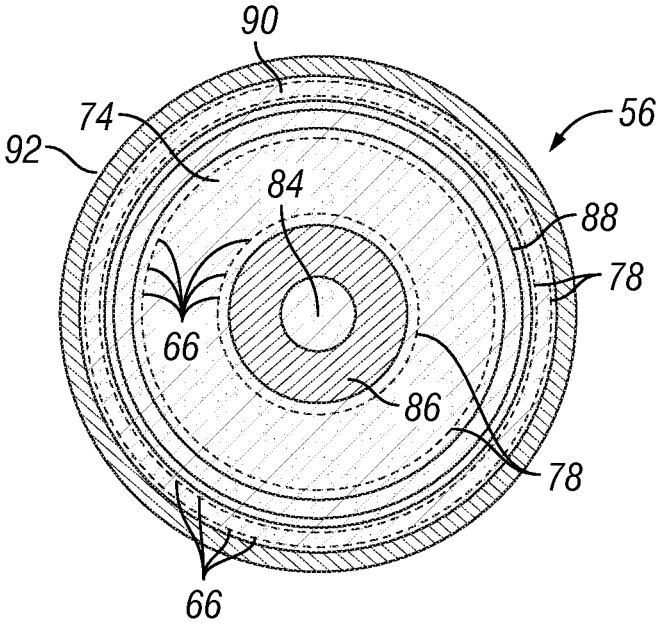
FIG. 8 is a cross-sectional view of another embodiment of an antenna module for use in a wellbore, according to an alternate embodiment of the present invention.

In the embodiment illustrated in FIG. 7, the composite 74 has material 66 dispersed throughout, as discussed above with reference to FIG. 6. However, composite 74 can be created in a variety of forms, such as those illustrated in FIGS. 3 through 6. For example, the characteristic improvement material 66 may be arranged in layers or strips 78, as illustrated in FIG. 8. In the particular example illustrated, the composite 74 that is located between conductive material 86 and winding 88 has inner and outer layers or strips 78 of material 66. Similarly, the additional layer 90 also comprises inner and outer strips or layers 78 of the material 66. In addition, composite 74 may be designed to have a high magnetic permeability by using, for example, ferroelastic materials.

Figure 9:
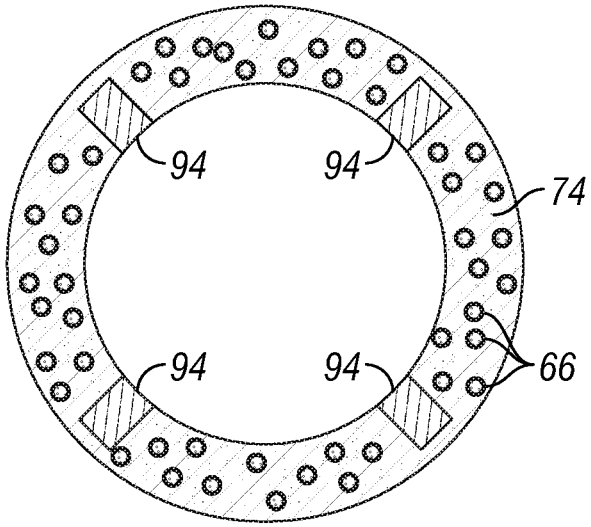
FIG. 9 is a cross-sectional view of another embodiment of an antenna module for use in a wellbore, according to an alternate embodiment of the present invention.

In many antenna modules and other downhole devices, conductive wires are used to carry current. In some applications, the flow of current can induce certain vibrations, and in other applications the conductive wires may be susceptible to vibrations induced by other components of the well device or overall well system. In FIG. 9, a plurality of conductive wires 94 traverses the module, e.g. the antenna module, in an axial direction as opposed to being in the cross-sectional plane. However, the arrangement of wires is merely representative, and many sizes and arrangements of wires can be used in a variety of downhole devices. As illustrated, the conductive wires 94 are encased with composite 74 to provide insulation and to reduce or eliminate vibration. For example, the conductive wires 94 can be isolated from vibrations induced by the logging device 50, drill string 24, or other components of the well system 20. Depending on the application, the composite 74 can be used to partially or fully encase the conductive wires 94.

Figure 10:
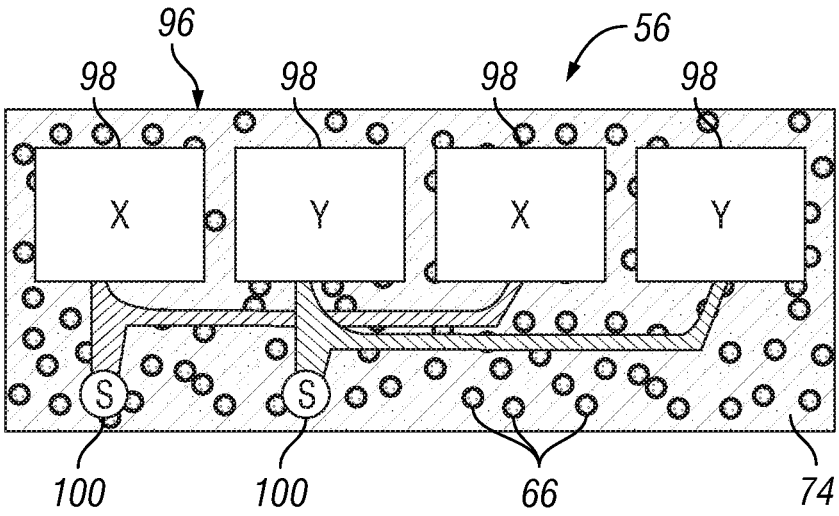
FIG. 10 is a cross-sectional view of another embodiment of antennas for use in a wellbore, according to an alternate embodiment of the present invention.

Referring generally to FIG. 10, another embodiment of an antenna module 56 is illustrated. In this embodiment, the negative stiffness material/negative Poisson's ratio material 66 is used in combination with a circuit board 96 to dampen vibrations for a plurality of antennas 98 mounted on circuit board 96. As illustrated, antennas 98 comprise alternating X and Y antennas connected to sources 100 in specific configurations. By way of example, the circuit board 96, if flexible, may be wrapped around a cylindrical structure such that the corresponding axes of the antennas 98 are diametrically opposed. The direction of current flow in the windings of the two X or two Y coils can be chosen either to result in a dipole or a quadrupole antenna. These effects are accomplished either through the direction of the windings or by the manner of connection to sources 100. In other embodiments, the printed circuit board 96 can be used in a generally flat configuration, as illustrated. Regardless of the orientation, material 66 is used to form composite 74 which is layered onto or otherwise applied to the circuit board 96 to reduce detrimental vibration that could otherwise interfere with the functionality of antennas 98. For each of the configurations shown in FIGS. 7-10, the presence of the negative stiffness/negative Poisson's ratio material substantially reduces the vibrational or translational motion coupling between adjacent components of the well system 20.

Figure 11:
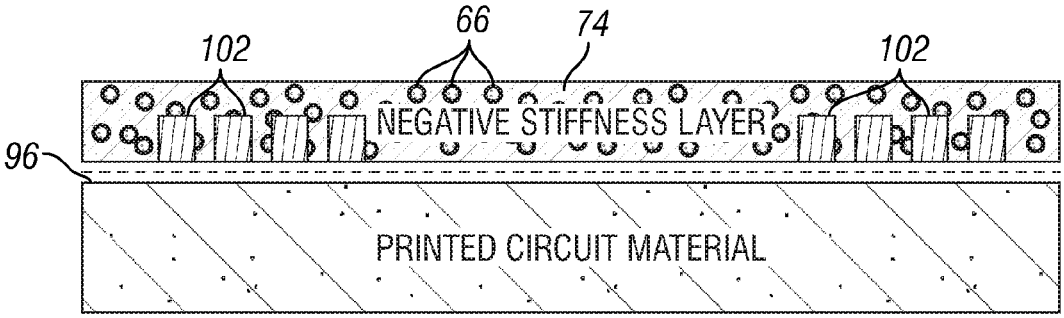
FIG. 11 is a cross-sectional view of another embodiment of a device for use in a wellbore, according to an alternate embodiment of the present invention.

The characteristic improvement material 66 also can be combined with other types of printed circuit boards, or the material can be used in composite 74 which, in turn, can be applied to various printed circuit boards. The composite 74 could be used as the substrate of a printed circuit board. One example of a printed circuit board 96 is illustrated in FIG. 11. In this embodiment, a variety of conductors and/or other circuit board components 102 are mounted on circuit board 96. A layer of composite 74 is deposited onto circuit board 96 over board components 102 to provide a substantially increased damping of vibration. The wires or other board components 102 can be arranged on circuit board 96 by, for example, etching or mounting. The use of negative stiffness material/negative Poisson's ratio material in composite 74 protects circuit board 96 and its numerous components in a variety of harsh environments susceptible to induced vibrations. The material 66 can be distributed through composite 74 according to a variety of techniques, as discussed above.

Figure 12:
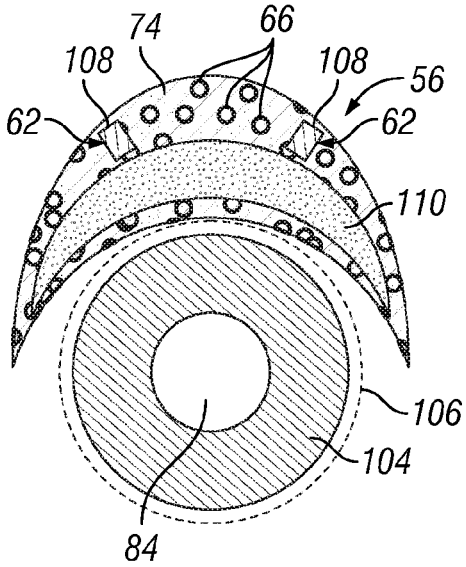
FIG. 12 is a cross-sectional view of another embodiment of a device for use in a wellbore, according to an alternate embodiment of the present invention.

In FIG. 12, another embodiment of a module 56 is illustrated. In this embodiment, a core member 104 defines mud channel 84 (or thru-wiring). The core member 104 may comprise a conductive material, such as the collar of a logging device, or the core member 104 may comprise a magnetic material, such as SmCo (samarium cobalt). A layer 106 of negative stiffness material/negative Poisson's ratio material 66 is wrapped around core member 104. Additionally, the module 56 may comprise conductive members 108 that form at least a portion of antenna 62. A high mu ferroelastic-containing material 110 is disposed between core member 104 and conductive members 108 to form the antenna module. The high mu material 110 and conductive numbers 108 also are surrounded by composite 74 to provide enhanced stiffness and to substantially increase damping of vibrations. Accordingly, when current passes through conductive members 108 and mechanical vibrations are induced, these vibrations are damped because the conductive members are embedded in the composite 74. Additionally, conductive members 108 are mechanically isolated from the high mu material 110 by the composite 74 which reduces unwanted ringing in the high mu material 110. Furthermore, the layer of composite 74 located between the core member 104 and the high mu material 110, as well as the layer 106 serve to reduce the vibrational coupling between module 56 and core member 104, and vice versa.

Various features and components having the characteristic improvement material 66 can be integrated into or used in conjunction with well system 20. Furthermore, the characteristic improvement material 66 can be used in the construction of well device components, or the material can be inserted into components that may be used in cooperation with other components to improve the functionality of the well device. Depending on the application, the characteristic improvement material 66 can be used to substantially increase the stiffness of components and/or to substantially increase the damping of vibration. The characteristic improvement material 66 also can be used to create a variety of composite materials.

The composite materials can be formed with many types of constituents according to the design parameters for a given well application. Additionally, the negative stiffness material/negative Poisson's ratio material can be distributed through a base material in a variety of patterns, orientations, distributions and ratios. Regardless, the resulting composite can be utilized in many types of well devices to substantially improve the functionality of those devices. For example, the composite material can be incorporated into antenna modules to reduce or eliminate mechanical vibrations and the consequent parasitic ringing.

As explained above, downhole conditions are very harsh and can cause serious vibrations in a tool string. The vibrations may be caused by the drilling process (i.e., drilling-induced), as a consequence of tripping in or out of the hole, or as a consequence of sending a current through a conductor (i.e., electrically-induced). The use of negative stiffness materials or negative Poisson's ratio materials for application in such environments is novel and non-obvious.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. An apparatus comprising:

a conductive material having a channel formed therethrough;

a first layer of composite material disposed about the conductive material and comprising a characteristic improvement material comprising at least one of a negative stiffness material or a negative Poisson's ratio material;

an antenna separate from the first layer of composite material and disposed about the first layer of composite material, the antenna comprising at least one conductive winding a second layer of composite material disposed around the antenna, the second layer of composite material being separate from the antenna and the first layer of composite material; and non-conductive layer of material disposed around the second layer of composite material.

2. The apparatus of claim 1, wherein the composite material comprises a distribution of a base material and the characteristic improvement material.

3. The apparatus of claim 1, wherein the composite material comprises a distribution of a high magnetic permeability material and the characteristic improvement material.

4. The apparatus of claim 1, wherein the characteristic improvement material is arranged in one or more layers or strips within a base material to form the composite material.

5. The apparatus of claim 1, wherein the apparatus comprises a while-drilling logging tool and the channel comprises a generally cylindrical mud channel.

6. The apparatus of claim 1, wherein the apparatus comprises a wireline logging tool and the channel comprises a through-wiring channel.

7. The apparatus of claim 1, wherein the at least one conductive winding comprises at least one coil winding.

8. The apparatus of claim 7, wherein the at least one coil winding comprises a first x-coil winding and a first y-coil winding.

9. The apparatus of claim 8, wherein the at least one coil winding comprises a second x-coil winding and a second y-coil winding, wherein the x-coil windings and the y-coil windings are arranged in an alternating manner.

10. The apparatus of claim 9, wherein the x-coil windings are diametrically opposed to each other and the y-coil windings are diametrically opposed to each other.

11. The apparatus of claim 1, wherein the second layer of composite material improves mechanical integrity of the conductive winding.

12. The apparatus of claim 1, wherein the antenna is part of a resistivity logging tool, a nuclear magnetic resonance logging tool, or a telemetry tool.

13. The apparatus of claim 1, wherein the second layer of composite material also comprises a characteristic improvement material.

14. A method for manufacturing a downhole apparatus comprising:

providing a conductive cylindrical structure having an opening formed therethrough defining a channel;

disposing a first layer of composite material about the conductive cylindrical structure, wherein the first layer of composite material comprises a characteristic improvement material comprising at least one of a negative stiffness material or a negative Poisson's ratio material;

disposing an antenna about the first layer of composite material, wherein the antenna comprises at least one conductive coil winding and is separate from the first layer of composite material;

disposing a second layer of composite material about the antenna, wherein the second layer of composite material is separate from the antenna and the first layer of composite material; and disposing a non-conductive layer of material about the second layer of composite material.

15. The method of claim 14, wherein the second layer of composite material also comprises a characteristic improvement material.

16. The method of claim 14, wherein the layer of composite material comprises at least one of a distribution of a base material and the characteristic improvement material or a distribution of a high magnetic permeability material and the characteristic improvement material.

17. The method of claim 14, wherein the composite material is the substrate of a flexible printed circuit board.

18. The method of claim 14, wherein the downhole apparatus comprises a while-drilling logging tool and the channel comprises a generally cylindrical mud channel formed within a conductive cylindrical structure.

* * * * *